US008882104B2

(12) United States Patent
Ueyama

(10) Patent No.: US 8,882,104 B2
(45) Date of Patent: Nov. 11, 2014

(54) MEDIUM RECEIVING DEVICE AND RECORDING APPARATUS

(71) Applicant: Seiko Epson Corporation, Tokyo (JP)

(72) Inventor: Naohiro Ueyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 74 days.

(21) Appl. No.: 13/781,127

(22) Filed: Feb. 28, 2013

(65) Prior Publication Data

US 2013/0286124 A1 Oct. 31, 2013

(30) Foreign Application Priority Data

Apr. 26, 2012 (JP) ..... 2012-100919

(51) Int. Cl.

| | |
|---|---|
| ***B65H 31/04*** | (2006.01) |
| ***B41J 13/00*** | (2006.01) |
| ***B65H 31/02*** | (2006.01) |
| ***B65H 29/52*** | (2006.01) |

(52) U.S. Cl.

CPC ..... *B41J 13/00* (2013.01); *B65H 2701/1311* (2013.01); *B65H 2404/693* (2013.01); *B65H 2701/11312* (2013.01); *B65H 2801/36* (2013.01); *B65H 31/02* (2013.01); *B65H 29/52* (2013.01)

USPC ..... 271/213; 271/223

(58) Field of Classification Search

USPC ..... 271/213, 218, 219, 220, 223, 189; 399/405; 400/647

See application file for complete search history.

(56) References Cited

FOREIGN PATENT DOCUMENTS

| | | | |
|---|---|---|---|
| JP | 01-070759 | U | 5/1989 |
| JP | 01-103656 | U | 7/1989 |
| JP | 2003-276928 | A | 10/2003 |
| JP | 2007-145459 | A | 6/2007 |
| JP | 2008-094575 | A | 4/2008 |
| JP | 2010-215367 | A | 9/2010 |

*Primary Examiner* — Michael McCullough

(74) *Attorney, Agent, or Firm* — Nutter McClennen & Fish LLP; John J. Penny, V.

(57) ABSTRACT

A medium receiving device includes: a medium holding member having a medium receiving surface that receives a part on the leading edge side in a discharge direction of a cut sheet; a medium edge restricting member including a restricting portion that restricts movement of the leading edge of the cut sheet to the discharge direction and a guidance portion that makes contact with the medium receiving surface so as to guide the leading edge from the medium receiving surface to the restricting portion; and a connecting bar that moves a plurality of medium edge restricting members together between a restricting position where the guidance portion makes contact with the medium receiving surface so as to guide the leading edge to the restricting portion and a non-restricting position where the guidance portion is separate from the medium receiving surface and does not guide the leading edge to the restricting portion.

12 Claims, 9 Drawing Sheets

MEDIUM RECEIVING DEVICE AND RECORDING APPARATUS

BACKGROUND

1. Technical Field

The present invention relates to medium receiving devices that receive media to be discharged at a lower side in the gravitational direction and recording apparatuses that include the medium receiving device mentioned above.

2. Related Art

As one type of recording apparatuses, an ink jet printer has been widely known that performs recording on a recording-target medium (hereinafter, simply called a "medium") fed out from a roll in which the medium has been wound and transported so as to pass through a recording section by ejecting a liquid from a recording head provided in the recording section, thereafter cuts the medium into a predetermined length, and discharges the cut medium.

This type of printer is provided with a medium receiving device that receives a medium, which is cut into a predetermined length and discharged after printing has been performed thereupon in a recording section, with a sheet-shaped medium holding member. That is, in the medium receiving device, the medium of the predetermined length is discharged and falls downward; the medium receiving device restricts the movement of the medium in a manner such that a restricting portion provided at the lower end side of a medium receiving surface, which is a sheet surface of the medium holding member, makes contact with the leading edge in a discharge direction of the medium after a part on the leading edge side in the discharge direction of the medium of the predetermined length has moved along the medium receiving surface by a predefined amount of length. The movement being restricted by the restricting portion, a predetermined amount of length of the medium is held on the medium receiving surface, while a part on the following edge side in the discharge direction of the medium is in a state that it hangs down from the upper end of the medium receiving surface toward a side which is separate from the medium receiving surface; as a result, the medium is held by the medium receiving device in an appropriate manner. Accordingly, in the case where the lengths in the discharge direction of the media that are discharged and fall downward are different from each other, it is necessary to change and adjust a contact position for the restricting portion that makes contact with the leading edge of the medium on the medium receiving surface in accordance with the respective lengths.

As a technique to change the above-mentioned contact position, for example, in JP-A-2010-215367, there is disclosed a technique in which a medium edge restricting member (butting member) that includes a restricting portion (second butting surface) capable of making contact with the leading edge in the discharge direction of a medium (sheet) is disposed so as to make contact with or separate from a medium receiving surface at an upper position relative to the other restricting portion (first butting surface) located at the lower end side of the medium receiving surface. In other words, such a technique is disclosed that selects and uses either the restricting portion (first butting surface) which restricts the movement of the medium by making contact with the leading edge in the discharge direction of the medium at the lower end side of the medium receiving surface or the restricting portion (second butting surface) which can make contact with the leading edge in the discharge direction of the medium at a position on the upper end side of the medium receiving surface relative to the contact position of the first butting surface, in accordance with the length in the discharge direction of the medium.

In JP-A-2010-215367, when the medium edge restricting member (butting member) is at a non-restricting position at which the medium edge restricting member (butting member) is not in contact with the medium receiving surface and does not restrict the movement of the medium with the restricting portion (second butting surface), the other restricting portion (first butting surface) makes contact with (catches) the leading edge in the discharge direction of the medium at the lower end side of the medium receiving surface. On the other hand, when the medium edge restricting member (butting member) is at a restricting position at which the medium edge restricting member (butting member) is in contact with the medium receiving surface and restricts the movement of the medium with the restricting portion (second butting surface), the medium to be discharged is made to be in slidingly contact with the medium edge restricting member (butting member) so that the leading edge of the medium is guided to the restricting portion (second butting surface). By changing the restricting portion (butting surface) being used as described above, the contact position at which the leading edge of the medium makes contact with the butting surface is changed. This makes it possible to adjust the length of a part on the leading edge side of the medium to be held on the medium receiving surface.

In general, in a recording apparatus that uses a medium being wound in a roll, a plurality of media having different lengths in a width direction orthogonal to the discharge direction of the media are used. Alternatively, a medium which is long in the width direction is used in some case. Accordingly, in a medium receiving device, a plurality of medium edge restricting members that restrict movement of the leading edge of the medium in the discharge direction are provided at predetermined intervals along the width direction of the medium. Further, for the sake of simplicity of the device, the above-mentioned plurality of medium edge restricting members provided along the width direction of the medium are generally moved together in an interlocking manner between a restricting position (catch position) and a non-restricting position (retreat position).

However, in the medium receiving device (sheet storage device) disclosed in JP-A-2010-215367, when the medium edge restricting member is at the restricting position, a gap is likely to be generated between the medium receiving surface (sheet guidance member) of the medium holding member and the medium edge restricting member (butting member). That is, the medium edge restricting members are moved together in an interlocking manner in the width direction orthogonal to the discharge direction of the medium to be discharged. Meanwhile, the medium receiving surface for receiving the medium is formed of a flexible sheet material such as cloth, for example. Accordingly, an end portion in the width direction of the medium receiving surface where the cloth, for example, is sewn to be prevented from coming loose, is prevented from expanding; on the contrary, the central portion where the cloth is not sewn, is not prevented from expanding. As a result, the medium receiving surface is bent because the central portion in the width direction thereof expands. This causes a gap to be generated between the medium receiving surface and the medium edge restricting member at the central portion even if the medium receiving surface is in contact with the medium edge restricting member at the end portions without a gap. Accordingly, because the leading edge in the discharge direction of the medium enters into the generated gap and is not guided from the medium receiving surface to the restricting portion included in the medium edge restricting member, there arises a problem that the medium is not held by the medium receiving device in an appropriate manner.

It is to be noted that such problem is not limited to the medium receiving device included in the ink jet printer described above; generally speaking, such problem has commonly occurred in medium receiving devices that receive media to be discharged at a lower side in the gravitational direction and recording apparatuses that include these medium receiving devices.

SUMMARY

An advantage of some aspects of the invention is to provide a medium receiving device that can receive a medium to be discharged in an appropriate holding mode and a recording apparatus that includes this medium receiving device.

A medium receiving device according to an aspect of the invention includes a medium holding member having a medium receiving surface that receives a part on the leading edge side in a discharge direction of a medium to be discharged; a plurality of medium edge restricting members that are arranged along a width direction of the medium orthogonal to the discharge direction, each of the medium edge restricting members including a restricting portion that restricts movement of the leading edge in the discharge direction of the medium therefrom to the discharge direction and a guidance portion that makes contact with the medium receiving surface so as to guide the leading edge of the medium from the medium receiving surface to the restricting portion; and a movement member that moves the plurality of medium edge restricting members together between a restricting position where the guidance portion makes contact with the medium receiving surface so as to guide the leading edge of the medium to the restricting portion and a non-restricting position where the guidance portion is separate from the medium receiving surface and does not guide the leading edge of the medium to the restricting portion, by being engaged with engagement portions provided in the medium edge restricting members. Further, in the medium receiving device, at least one of the engagement portions respectively provided in the plurality of medium edge restricting members includes a gap between the engagement portion and the movement member in a movement direction of the medium edge restricting member.

According to this structure, in the case where movement amounts of the respective guidance portions to reach the medium receiving surface are different from each other in the plurality of medium edge restricting members that are moved together by the movement member, the gap provided between the engagement portion of the medium edge restricting member and the movement member in the movement direction cancels out the difference in the movement amounts. That is, by providing a gap in accordance with the difference in the movement amounts, it is possible to cause the respective guidance portions of the plurality of medium edge restricting members to make contact with the medium receiving surface. As a result, because the leading edge in the discharge direction of the medium can be surely guided from the medium receiving surface to the restricting portion of the medium edge restricting member, the medium receiving device can receive the medium to be discharged in an appropriate holding mode.

In the medium receiving device according to the aspect of the invention, it is preferable that each of the plurality of medium edge restricting members be rotatably provided about a rotational shaft having an axis line in the width direction of the medium, and that each of the engagement portions include the aforementioned gap between the engagement portion and the movement member in a rotational direction of each of the medium edge restricting members.

According to this structure, the plurality of medium edge restricting members when rotated by the engagement with the movement member and moved between the restricting position and the non-restricting position, make the gaps provided in the rotational direction cancel out the difference in the movement amounts. This makes it possible to cause each of the guidance portions of the plurality of medium edge restricting members to be in contact with the medium receiving surface.

In the medium receiving device according to the aspect of the invention, it is preferable for the engagement portion with which the movement member engages to be arranged at a different position from the center of the rotational shaft about which the medium edge restricting member rotates.

According to this structure, the movement member engages with the engagement portions that are arranged and distanced from the rotational shafts of the plurality of medium edge restricting members, and moves (rotates) the medium edge restricting members with a moment force generated about the rotational shafts. As a result, the movement member can move the guidance portions of the plurality of medium edge restricting members with ease.

In the medium receiving device according to the aspect of the invention, it is preferable for the engagement portion to be a polygonal through-hole and for the movement member to be a shaft member that is inserted through the above through-hole and whose cross-section with an axis line in the width direction of the medium is formed in a polygonal shape having the same number of corners as the engagement portion.

According to this structure, because the movement member that moves and the engagement portion can easily engage with each other by causing the surfaces thereof to make contact with each other, the movement member can stably move the medium edge restricting member. Note that, in the case where the movement member is a shaft member that is positioned on the shaft center of the rotational shaft of the medium edge restricting member, that is, in the case where the rotational shaft functions as the movement member, the movement member whose cross-section is polygonal can surely rotate the medium edge restricting member by being engaged with the engagement portion on the corners without slipping.

In the medium receiving device according to the aspect of the invention, it is preferable that, in the case where the medium edge restricting member is at the non-restricting position, a storage unit which stores at least the guidance portion be provided, and the storage unit be arranged on a side opposed to the medium receiving surface of the medium holding member and guide the medium to be discharged to an area between the storage unit and the medium receiving surface, and that the storage unit guide the medium to be discharged to an area between the storage unit and the guidance portion in the case where the medium edge restricting member is at the restricting position.

According to this structure, the storage unit can guide the medium to be discharged between the storage unit and the medium receiving surface in a state of the medium edge restricting member being at the non-restricting position in which the guidance portion is being stored, and can also guide the medium to be discharged between the storage unit and the guidance portion in a state of the medium edge restricting member being at the restricting position in which the guidance portion has moved out from the storage unit to be in contact with the medium receiving surface. Therefore, it is possible to prevent the medium receiving device from becoming large because a movement range in which the medium edge restricting member moves is limited to a range between the storage unit and the medium receiving surface.

In the medium receiving device according to the aspect of the invention, it is preferable that such a single bias member be provided that biases the medium edge restricting member so that the medium restricting member is caused to move toward the restricting position in the case where the medium edge restricting member that moves is at a position on the restricting position side relative to a reference position between the restricting position and the non-restricting position, and also biases the medium edge restricting member so that the medium edge restricting member is caused to move toward the non-restricting position in the case where the medium edge restricting member is at a position on the non-restricting position side relative to the above reference position.

According to this structure, the single bias member biases the medium edge restricting member toward the two stable positions for the medium edge restricting member. This makes it possible to realize a medium receiving device in which complexity of the device structure due to an increased number of bias members is suppressed.

A recording apparatus according to an aspect of the invention includes a recording section that performs recording by adhering a liquid to a medium, a discharge section that discharges the medium from the recording section, and the medium receiving device in the structure described above.

According to this structure, it is possible to obtain a recording apparatus that can surely guide the leading edge in a discharge direction of a medium from the medium receiving surface to the restricting portion of the medium edge restricting member.

BRIEF DESCRIPTION OF THE DRAWINGS

The invention will be described with reference to the accompanying drawings, wherein like numbers reference like elements.

FIG. 2A is a plan view of the medium receiving device and FIG. 2B is a perspective view thereof.

FIG. 8A is a diagram illustrating a state in which the medium edge restricting member makes contact with the medium receiving surface in the case where a gap between a movement operating lever and an engagement portion of the medium edge restricting member is not present in the movement direction, and FIG. 8B is a diagram illustrating a state in which the medium edge restricting member makes contact with the medium receiving surface in the case where a gap between the movement operating lever and the engagement portion of the medium edge restricting member is present in the movement direction.

DESCRIPTION OF EXEMPLARY EMBODIMENTS

Hereinafter, a recording apparatus according to an embodiment of the invention will be described with reference to the drawings.

The recording apparatus according to the embodiment is an apparatus that includes a liquid ejecting head, serving as a recording head, which ejects ink as an example of a liquid, and records an image by ejecting ink from the recording head onto a surface (recording-target surface to be recorded) of a sheet (e.g., paper form) as a long-length medium that is fed out and transported from a roll made of the medium wound in a roll shape.

Figure 1:
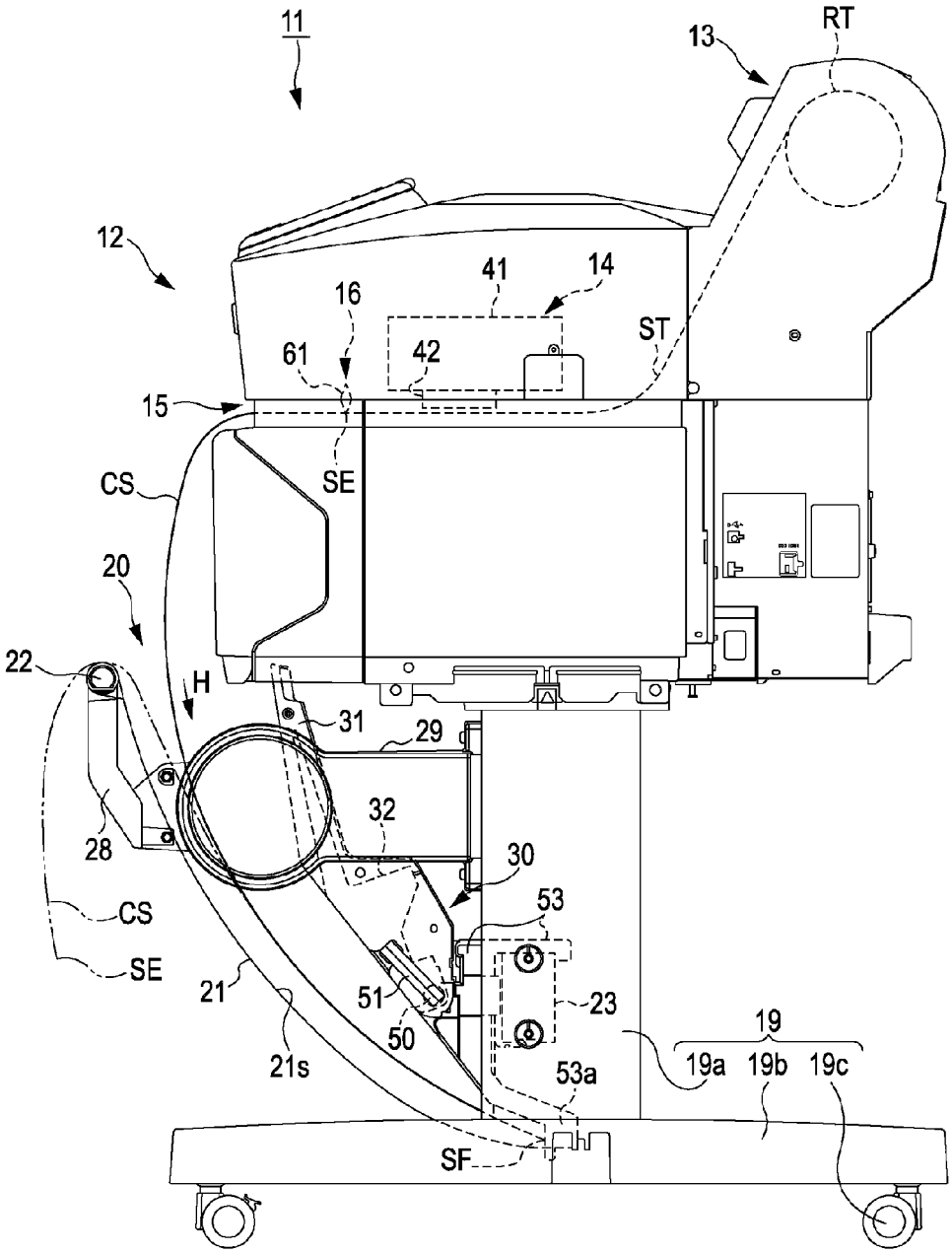
FIG. 1 is a side view schematically illustrating the structure of a recording apparatus according to an embodiment of the invention.

As shown in FIG. 1, a recording apparatus 11 includes: a main apparatus body 12 that performs recording on a sheet ST fed out and transported from a roll RT, and thereafter cuts the sheet ST to be discharged as a cut sheet CS; and a medium receiving device 20 that is provided under the main apparatus body 20 in a vertical direction on the gravitational direction side so as to receive the discharged cut sheet CS. The main apparatus body 12 is formed in an approximately rectangular parallelepiped whose lengthwise direction is the width direction of the sheet ST (front-back surface direction of the paper in the drawing) that intersects with a discharge direction of the sheet ST (an arrow H), and is connected and fixed to a plate-like base unit 19 which is formed in an approximately inverted T shape and is provided at both end sides in the lengthwise direction of the main apparatus body 12. Similarly, constituent members of the medium receiving device 20 are so provided as to be attached to the base unit 19.

The base unit 19 includes a pair of legs 19*a* each upper end of which is connected and fixed to each of the lower sides of both ends in the lengthwise direction of the main apparatus body 12, and a brace member 23 (see FIGS. 2A and 2B) that extends in the lengthwise direction so as to connect the pair of legs 19*a*. Further, a foundation portion 19*b* is provided extending from a base end portion of the leg 19*a* toward both ends in the horizontal direction; with casters mounted to the foundation portion 19*b*, the base unit 19 can be easily moved together with the main apparatus body 12.

The main apparatus body 12 is constructed in a case body configured of a plurality of members, and includes a medium storage unit 13 that stores a long sheet ST as the roll RT, a recording section 14 that performs recording on the sheet ST, and a discharge section 15 that discharges the sheet ST from the main apparatus body 12 toward the medium receiving device 20. Further, a cutting unit 16 for cutting the sheet ST to be discharged is provided between the recoding section 14 and the discharge section 15.

The medium storage unit 13 stores the long-length sheet ST wound in a roll as the roll RT in a storage space so that the roll RT can be rotated about a roll shaft (not shown), and feeds out the long-length sheet ST from the roll RT and transports it to the recording section 14.

The recording section 14 is positioned on the recording-target surface side (anti-gravitational direction side) of the sheet ST fed out from the roll RT, and includes a carriage 41 that moves back and forth driven by a not-shown driving unit (a motor or the like) in the lengthwise direction of the main apparatus body 12, which is the width direction of the sheet ST. The carriage 41 includes a recording head 42 at a position opposed to the sheet ST. In addition, the recording apparatus 11 includes a support platform (not shown) for supporting the sheet ST from the opposite side (rear side) with respect to the recording head 42, a transport roller (not shown) for transporting the sheet ST and so on, and transports the sheet ST fed out from the roll RT to the discharge section 15 side, which is on the downstream side in the transport direction. During this transport process, recording is performed on the sheet ST by ejecting ink from the recording head 42 provided in the carriage 41, which moves back and forth in the width direction of the sheet ST, onto a recording-target surface of the sheet ST.

The discharge section 15 is a plane extending along the lengthwise direction of the main apparatus body 12, is larger in width than the sheet ST, and has a medium support surface (not shown) that supports the sheet ST transported from the recording section 14 by making contact with the undersurface, which is on the opposite side to the recording-target surface (gravitational direction side) of the sheet ST. Being supported by this medium support surface, the sheet ST is transported and moved, and discharged from the end of the medium support surface on the discharge direction side toward the medium receiving device 20 positioned under (on the gravitational direction side of) the main apparatus body 12.

Further, the main apparatus body 12 includes the cutting unit 16 that cuts the sheet ST into a sheet having a predetermined length in the transport direction, that is, into the cut sheet CS after the recording is performed in the recording section 14 on the sheet ST having been fed out from the roll RT. The cutting unit 16 is rotated by a driving unit (not shown) and includes a rotational cutter 61 that moves in the width direction of the sheet ST. The sheet ST is cut by the rotational cutter 61 moving in the width direction of the sheet ST while making a cut in the thickness direction of the sheet ST. Then, the sheet ST having been cut by the cutting unit 16 during the transport is discharged as a cut sheet CS from the discharge section 15 toward the medium receiving device 20.

Next, the medium receiving device 20 will be described with reference to FIG. 1, FIGS. 2A and 2B, and FIG. 3. Note that in FIGS. 2A and 2B, the medium receiving device 20 in a state in that the main apparatus body 12 is disconnected and detached from the base unit 19 is illustrated. Meanwhile, in FIG. 3, the medium receiving device 20 in a state in that a medium holding member 21 and one of base members 29 are removed is illustrated.

Figure 2A:
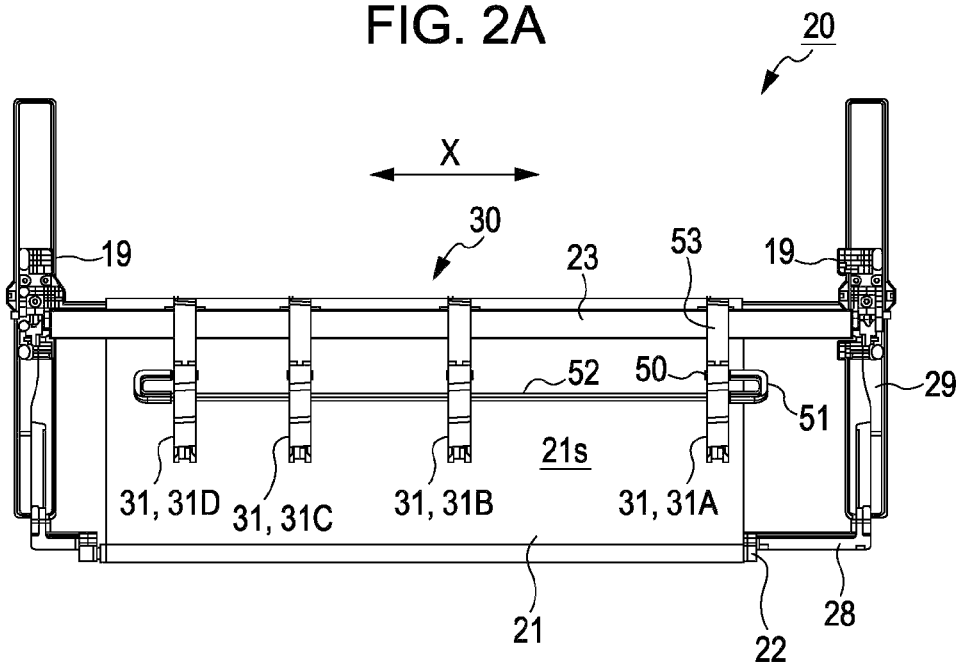
FIGS. 2A and 2B are diagrams illustrating a medium receiving device included in the recording apparatus according to the embodiment of the invention; specifically.
Figure 2B:
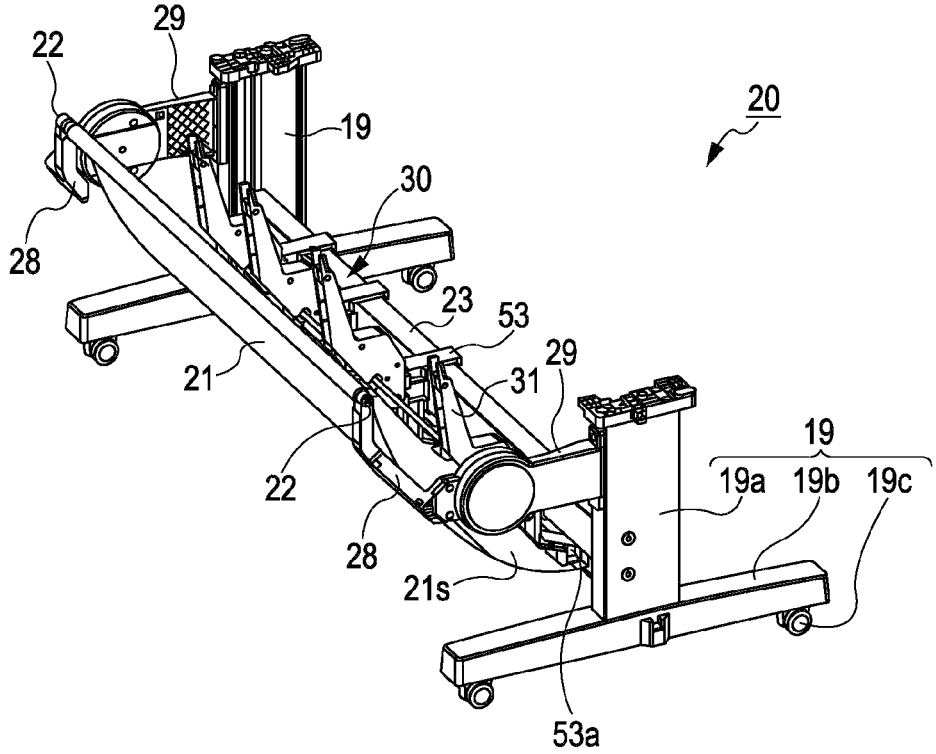

As shown in FIG. 1 and FIGS. 2A, 2B, the medium receiving device 20 includes the medium holding member 21 having a medium receiving surface 21*s* on one face (a face on the anti-gravitational direction side) thereof that receives cut sheet CS to be discharged and a medium path change section 30 arranged with a gap between the medium path change section and the medium holding member 21, and is provided under the main apparatus body 12 in a state in which the above-mentioned constituent elements are attached to the base unit 19.

The medium holding member 21 is formed by using a flexible material such as cloth, and an end portion of the medium receiving surface 21*s* on the upstream side in the movement direction of the discharged cut sheet CS which is orthogonal to the lengthwise direction of the main apparatus body 12 (a two-headed arrow X in the drawing), is wound on a support shaft 22 formed in a columnar or cylindrical shape and extending in the lengthwise direction. Both ends of the support shaft 22 are respectively mounted on the tips of arms 28 formed in an L shape; the base end sides of the arms 28 are supported by the pair of legs 19*a* via the base members 29 constructed in a cantilever manner. Further, an end portion of the medium receiving surface 21*s* on the downstream side in the movement direction of the cut sheet CS, is fixed to catching portions 53*a* provided at the lower ends of a plurality of catch members 53 (four in this case) attached to the brace member 23.

Figure 3:
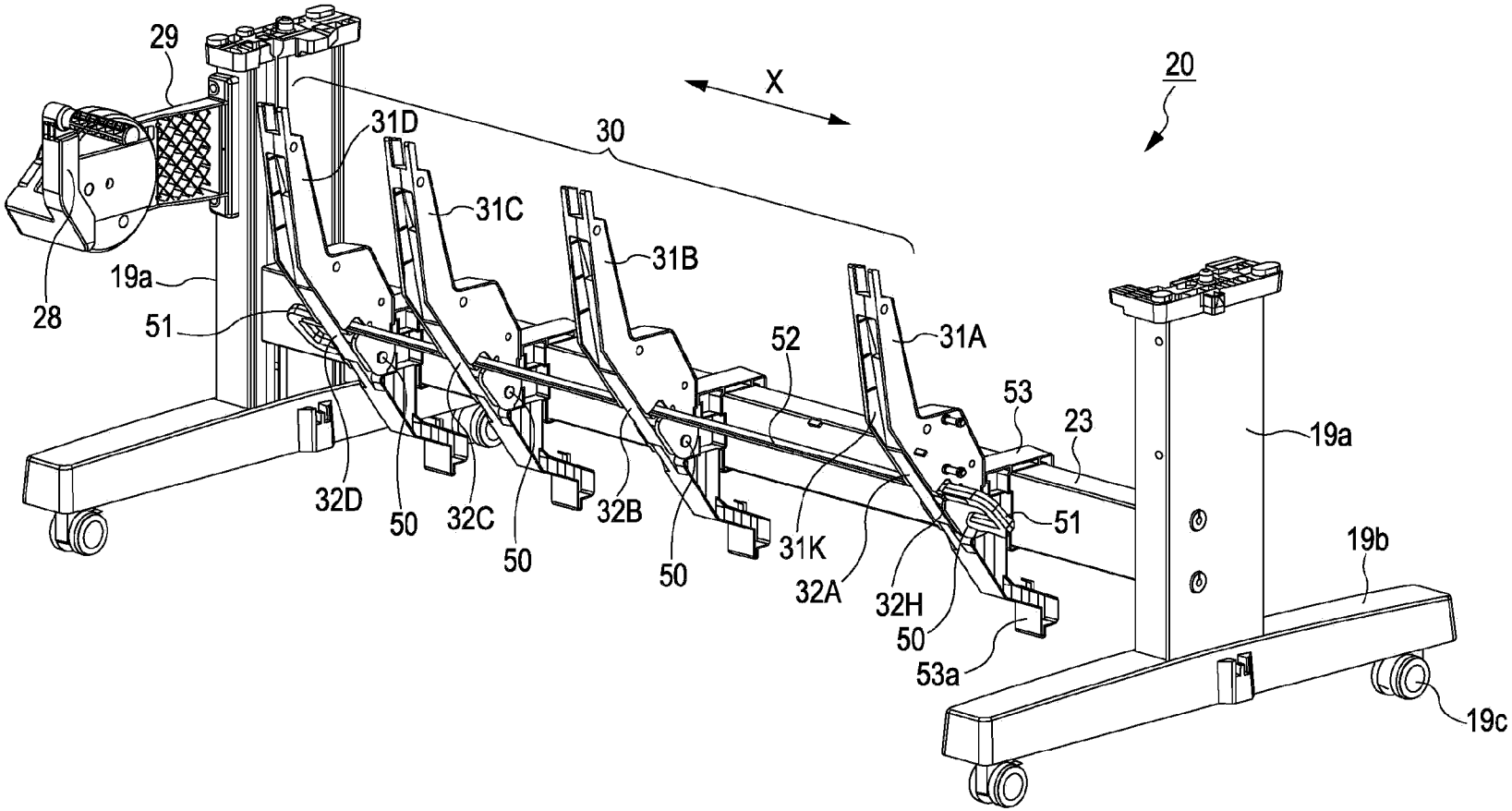
FIG. 3 is a perspective view illustrating the medium receiving device with its medium holding member being removed.

As shown in FIGS. 2A, 2B and FIG. 3, the medium path change section 30 includes a plurality of medium edge restricting members 32 that are provided in a rotatable manner about rotational shafts 50 provided in the catch members 53 within a plane face orthogonal to the lengthwise direction, and a plurality of storage frame bodies 31 that are attached to the catch members 53 and function as storage units for storing the medium edge restricting members 32. In this embodiment, in accordance with the difference in width of the cut sheets CS to be discharged, four medium edge restricting members 32 (32A, 32B, 32C, 32D) formed in an approximately plate-like shape are provided at predetermined intervals each corresponding to a width of each of the cut sheets CS. Further, the respective medium edge restricting members 32 (32A, 32B, 32C, 32D) are stored in the storage frame bodies 31 (storage frame bodies 31A, 31B, 31C and 31D) through openings 31K included in the respective storage frame bodies 31; each of the openings 31K is formed of two frame cases overlapping with each other in the lengthwise direction. In other words, in accordance with the difference in width of the cut sheets CS, four catch members 53 are attached to the brace member 23 at predetermined intervals each corresponding to a width side of each of the cut sheets CS. Needless to say, multiple catch members, that is, three or five catch members 53 are attached to the brace member 23 in accordance with the difference in width of the cut sheets CS.

With the structure described above, in the recording apparatus 11, the discharged cut sheet CS is guided to an area between the storage frame bodies 31 and the medium holding member 21 (the medium receiving surface 21*s*) so as to move on a path along the medium receiving surface 21*s* in a state in that the medium edge restricting members 32 are stored in the storage frame bodies 31, as shown in FIG. 1. Then, in a state in which a leading edge SF in the movement direction (the arrow H) of the cut sheet CS is in contact with the catching portion 53*a* of the catch member 53 so that the movement of the cut sheet CS is restricted, a part on the leading edge SF side of the cut sheet CS is held on the medium receiving surface 21*s*. On the other hand, a part on the side of a following edge SE of the cut sheet CS is not held by the medium receiving surface 21*s*, and is in a state in which it hangs down being separated from the medium receiving surface 21*s*, as indicated by a double-dot dash line in FIG. 1. Taking this posture, the cut sheet CS is received in the medium receiving device 20 in an appropriate holding mode.

In the recording apparatus 11 according to this embodiment, the medium path change section 30 is structured so that the medium edge restricting members 32 stored in the respective storage frame bodies 31 move to come out together from the storage frame bodies 31. In other words, as shown in FIG. 3, through-holes 32H (see FIG. 4) are provided in the medium edge restricting members 32 stored in the storage frame bodies 31. A connecting bar 52 serving as a movement member whose axis line direction is the lengthwise direction, is inserted through and engaged with the through-holes 32H provided in the medium edge restricting members 52, in which the through-holes 32H serve as the engagement portions; note that, handles 51 are attached to both ends of the connecting bar 52. With this structure, if a user of the recording apparatus 11, for example, grips the handle 51 and moves the connecting bar 52 about the rotational shafts 50 (moves the bar in a circumferential direction), the movement of the connecting bar 52 causes the respective medium edge restricting members 32 to swing about the rotational shafts 50 so as to come out together from the storage frame bodies 31.

Next, the structure of the medium edge restricting member 32 that swings in response to the movement of the connecting bar 52 in the circumferential direction will be described with reference to FIG. 4. In this embodiment, the four storage frame bodies 31 and four medium edge restricting members 32 included in the medium path change section 30, respectively have the same structures. Therefore, in the following description, the structure of one of the medium edge restricting members 32 concerning the swing movement thereof will be described with reference to FIG. 4.

Figure 4:
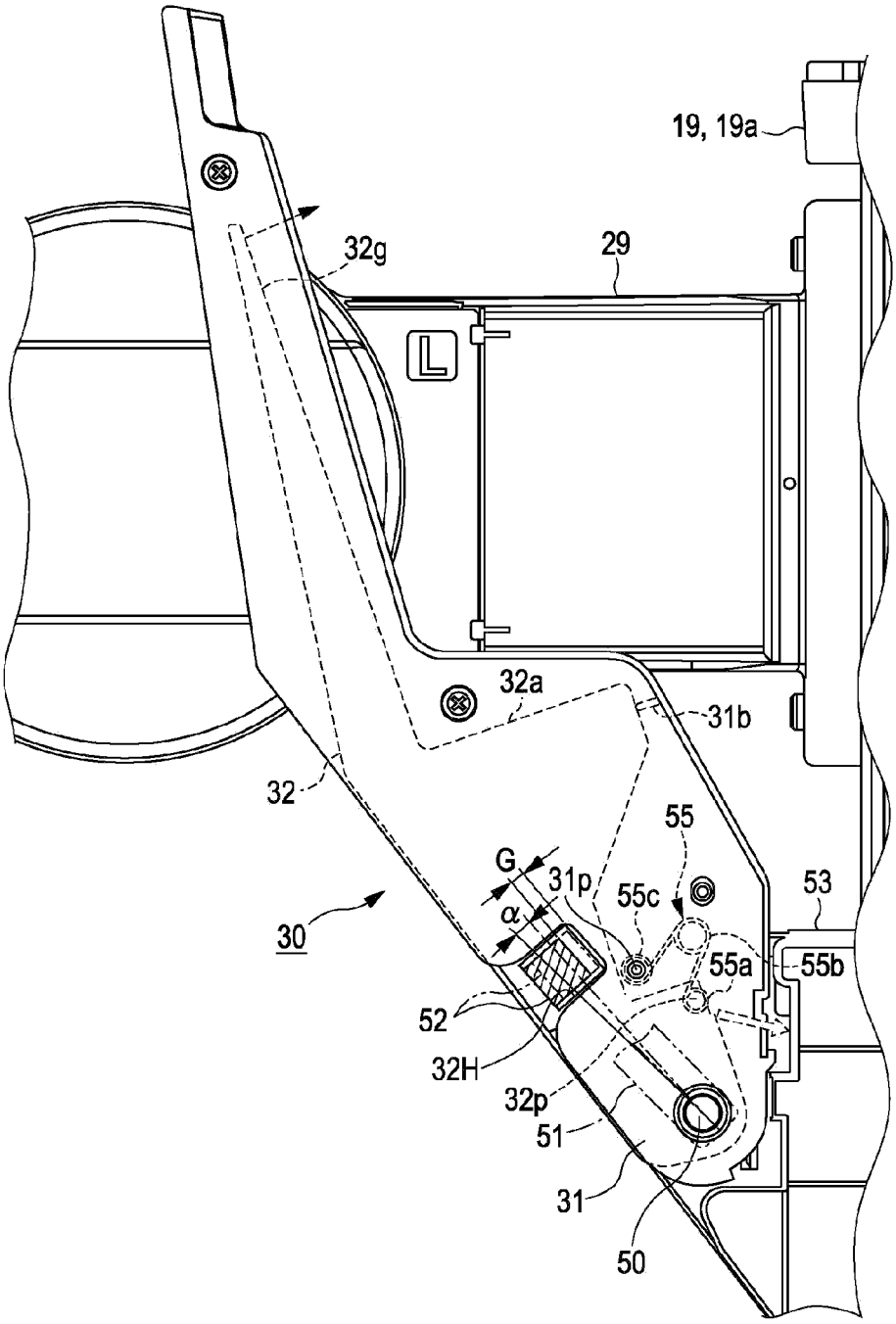
FIG. 4 is a side view illustrating the structure of a medium edge restricting member concerning the movement thereof according to the embodiment.

As shown in FIG. 4, the through-hole 32H whose hole shape is polygonal (quadrilateral in this case) is provided in the medium edge restricting member 32 stored in the storage frame body 31 that is attached to the catch member 53; the connecting bar 52, which is a shaft member made of a bar or pipe member whose cross-section shape is polygonal (quadrilateral in this case) having the same number of corners as the through-hole 32H, is inserted through the through-hole 32H.

A gap G is provided between the connecting bar 52 and the through-hole 32H in the movement direction of the connecting bar 52 when the bar moves about the rotational shaft 50 in the circumferential direction. The gap G allows the connecting bar 52 to move freely about the rotational shaft 50 in the circumferential direction within a predetermined angle of $\alpha$ between two contact positions (positions indicated by a full line and a double-dot dash line in the drawing) in the movement direction in which the connecting bar 52 moves to make contact with the through-hole 32H. In other words, the medium edge restricting member 32 swings freely with respect to the connecting bar 52 within the angle of $\alpha$.

One end of the handle 51 is fitted into the rotational shaft 50, and both ends of the connecting bar 52 are respectively fitted into and attached to the other end of the handle 51. Accordingly, rotating the handle 51 about the rotational shaft 50 moves the connecting bar 52 about the rotational shaft 50 in the circumferential direction; then, the connecting bar 52 engages with the medium edge restricting member 32 when the bar has moved to the contact position where the gap between the connecting bar 52 and the through-hole 32H is zero on the movement direction side (a position indicated by the full line or the double-dot line in the drawing). As a result, while moving in the circumferential direction, the connecting bar 52 swings the medium edge restricting members 32 in the order of the through-holes 32H with which the connecting bar 52 makes contact on the movement direction side; and when the connecting bar 52 has made contact with all the medium edge restricting members 32 at their through-holes 32H on the movement direction side, the medium edge restricting members 32 are swung all together by the connecting bar 52.

In this embodiment, the medium edge restricting member 32 includes a guidance portion 32*g* that makes contact with the medium receiving surface 21*s* of the medium holding member 21 when being caused to come out from the storage frame body 31 by the movement of the connecting bar 52 in the circumferential direction, so as to guide a part on the leading edge SF side of the cut sheet CS discharged from the main apparatus body 12 side. Further, the medium edge restricting member 32 includes a restricting portion 32*a* that makes contact with the leading edge SF of the cut sheet CS that moves being guided by the guidance portion 32*g*, so as to restrict the movement of the cut sheet CS.

Moreover in this embodiment, while the guidance portion 32*g* is being stored in the storage frame body 31, the medium edge restricting member 32 is biased by a bias member in a storage direction of the guidance portion 32*g*. As the bias member, a torsion coil spring 55 is used; by incorporating a coil portion 55*b* into the medium path change section 30 in a state in which the coil portion 55*b* is wound up and tightened, the medium edge restricting member 32 is biased in the storage direction in which the guidance portion 32*g* is stored into the storage frame body 31.

That is, as shown in FIG. 4, a ring portion 55*a* is formed at one end of the torsion coil spring 55, and a shaft pin 32*p* provided in the medium restricting member 32 is rotatably inserted at the inner side of the ring portion 55*a*; a ring portion 55*c* is formed at the other end of the torsion coil spring 55, and a shaft pin 31*p* provided in the storage frame body 31 is rotatably inserted into the inner side of the ring portion 55*c*. With these shaft pins 31*p* and 32*p* being inserted, the coil portion 55*b* is in a wound-and tightened state in which the inner diameter of the coil portion 55*b* is smaller. This makes the torsion coil spring 55 generate a bias force that biases the shaft pin 32*p* of the medium edge restricting member 32 to a direction in which the pin 32*p* is distanced from the shaft pin 31*p* of the storage frame body 31, as indicated by a broken-line outline arrow in the drawing.

In this embodiment, the shaft pins 31*p* and 32*p* are provided at the positions distanced from the rotational shaft 50 to the upper side, and the bias direction of the bias force of the torsion coil spring 55 to bias the shaft pin 32*p* is set to be deviated from the rotational shaft 50 to the upper side. Accordingly, the torsion coil spring 55 biases the medium edge restricting member 32 about the rotational shaft 50 to the storage direction in which the guidance portion 32*g* of the medium edge restricting member 32 is stored into the storage frame body 31 (a broken-line arrow in the drawing).

Further, in this embodiment, part of the medium edge restricting member 32 being biased makes contact with a projection 31*b* provided in the storage frame body 31 so that the swing of the medium edge restricting member 32 in the storage direction is restricted. The position at which the medium edge restricting member 32 is stored with the swing being restricted, is considered to be a storage position of the medium edge restricting member 32; and at least the guidance portion 32*g* is stored in the storage frame body 31 at the storage position.

The torsion coil spring 55 in this embodiment is so structured as to bias the medium edge restricting member 32 in the storage direction as described above when the medium edge restricting member 32 is to be stored in the storage frame body 31, and to bias the medium edge restricting member 32 to the medium receiving surface 21*s* side when the medium edge restricting member 32 having come out from the storage frame body 31 is to be in contact with the medium receiving surface 21*s*. The structure mentioned above will be described in detail with reference to FIGS. 5 and 6. Note that in FIGS.

5 and 6, the storage frame body 31 is illustrated in a state in which the frame case on one side (the front side of the paper in the drawing) is removed.

Figure 5:
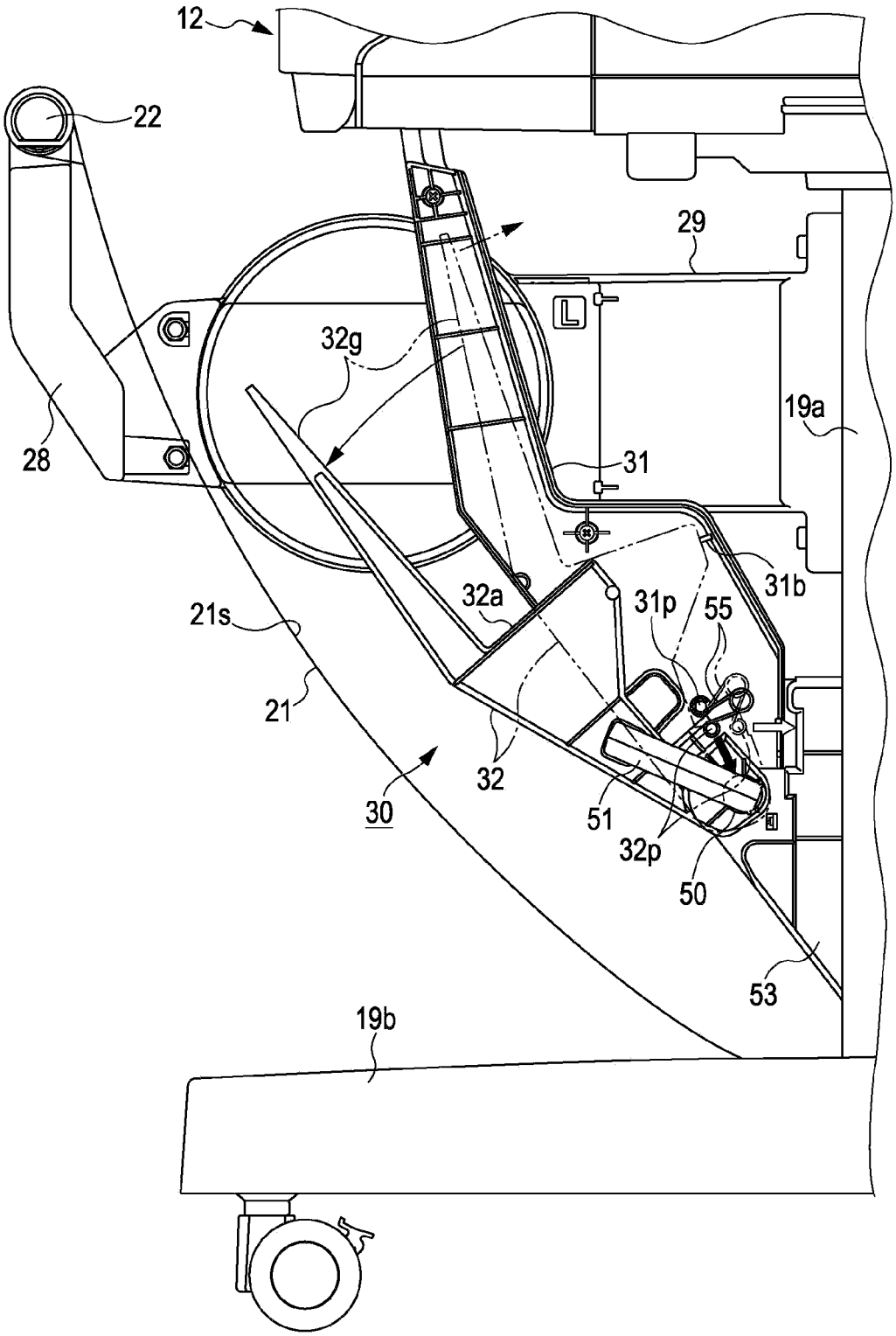
FIG. 5 is a schematic diagram illustrating a state in which the medium edge restricting member has moved from a stored state to a reference position.

As shown in FIG. 5, for example, if a user of the recording apparatus 11 grips the handle 51 and moves the connecting bar 52 about the rotational shaft 50 in the circumferential direction, the movement of the connecting bar 52 causes the medium edge restricting member 32 to make contact with the connecting bar 52 on the movement direction side in the through-hole 32H and swing about the rotational shaft 50 so as to come out from the storage frame body 31. Since the guidance portion 32*g* is being biased to the storage frame body 31 side by the torsion coil spring 55 at the time when the above swing movement starts, the connecting bar 52 makes contact with a portion on the side indicated by a full line in FIG. 4, that is, a portion on the medium receiving surface 21*s* side of the through-hole 32H, so as to move the medium edge restricting members 32 all together in the circumferential direction, or swing them all together.

Subsequently, when the medium edge restricting member 32 is swung from the storage position indicated by a double-dot dash line in the drawing to a coming-out position indicated by a full line in the drawing where the medium edge restricting member 32 doses not make contact with the medium holding member 21, the torsion coil spring 55 is in a non-biasing state in which it does not generate a bias force to bias the medium edge restricting member 32 in the storage direction toward the storage frame body 31.

In other words, since the swing of the medium edge restricting member 32 causes the shaft pin 32*p* to move about the rotational shaft 50 in the circumferential direction, the torsion coil spring 55 is changed from a state indicated by a double-dot dash line to a state indicated by a full line in the drawing. With the above change of the state of the torsion coil spring 55, the bias direction of the bias force of the torsion coil spring 55 exerted on the shaft pin 32*p* gradually changes from a direction which is deviated from the rotational shaft 50 to the upper side as indicated by a full-line outline arrow in the drawing to a direction coming closer to the rotational shaft 50. Then, when the medium edge restricting member 32 has moved to the coming-out position, the bias direction of the bias force of the torsion coil spring 55 exerted on the shift pin 32*p* faces, as indicated by a full-line bold arrow in the drawing, to the shaft center of the rotational shaft 50. As a result, because the bias force of the torsion coil spring 55 does not generate a moment force to swing the medium edge restricting member 32 about the rotational shaft 50, the medium edge restricting member 32 is in a state such that the bias force toward the storage frame body 31 is not generated in the storage direction.

Figure 6:
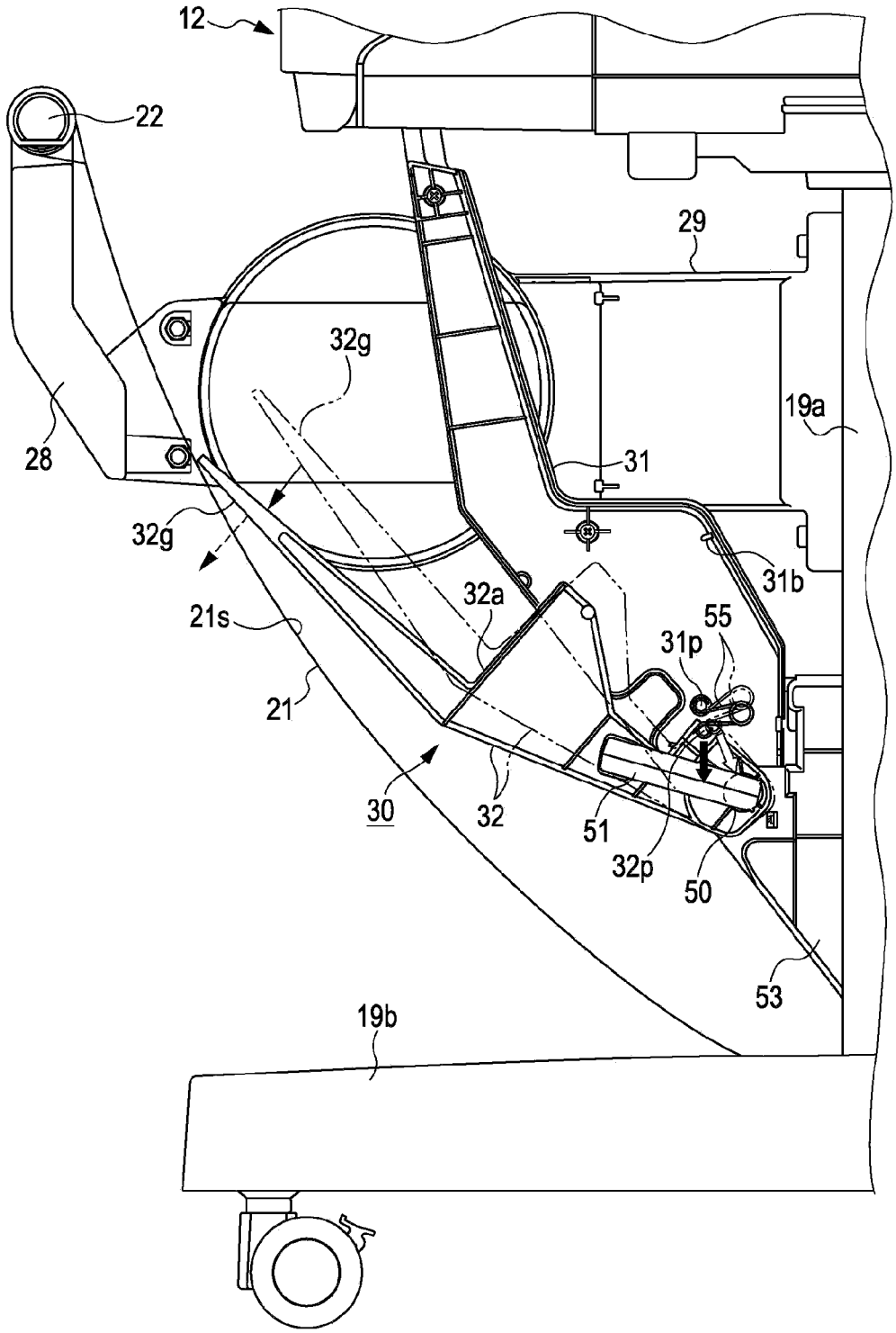
FIG. 6 is a schematic diagram illustrating a state in which the medium edge restricting member has moved from the reference position to the side of a medium receiving surface.

Next, as shown in FIG. 6, if the user of the recording apparatus 11 grips the handle 51 and further moves the connecting bar 52 about the rotational shaft 50 in the circumferential direction, the movement of the connecting bar 52 causes the medium edge restricting member 32 to further swing about the rotational shaft 50 so that the tip of the guidance portion 32*g* comes to be in contact with the medium receiving surface 21*s*. At the time when the guidance portion 32*g* makes contact with the medium receiving surface 21*s*, the torsion coil spring 55 is in a biasing state in which the medium edge restricting members 32 (guidance portion 32*g*) is biased toward the medium receiving surface 21*s* side.

That is, if the medium edge restricting member 32 further swings in order that the guidance portion 32*g* is displaced from the coming-out position to a touch position indicated by a full line in the drawing where the guidance portion 32*g* makes contact with the medium holding member 21, the shaft pin 32*p* further moves in the circumferential direction with the swing of the medium edge restricting member 32. As a result, the bias direction of the bias force of the torsion coil spring 55 exerted on the shaft pin 32*p* changes, with the displacement of the torsion coil spring 55, from a direction indicated by a full-line outline arrow in the drawing to a direction deviated from the rotational shaft 50 and facing to the medium holding member 21 side as indicated by a full-line bold arrow in the drawing when the medium edge restricting member 32 has moved to the touch position. As a result, because the bias force of the torsion coil spring 55 generates a moment force that swings the medium edge restricting member 32 about the rotational shaft 50 to the medium holding member 21 side, the medium edge restricting member 32 (guidance portion 32*g*) is biased to a direction in which the guidance portion 32*g* pushes the medium receiving surface 21*s* (a broken-line arrow in the drawing).

As described above, the torsion coil spring 55 biases the medium edge restricting member 32, which moves between the storage position and the touch position, to make it move to the storage frame body 31 side when the medium edge restricting member 32 is on the storage position side with respect to the coming-out position that the medium edge restricting member 32 reaches when it comes out from the storage frame body 31; on the other hand, the torsion coil spring 55 biases the medium edge restricting member 32 to make it move to the medium holding member 21 side when the medium edge restricting member 32 is on the touch position side with respect to the coming-out position. In other words, taking the coming-out position as a reference position, the medium edge restricting member 32 is biased by the single torsion coil spring 55 to move to the storage frame body 31 side in the case where the member is at a position which is closer to the storage frame body 31 with respect to the reference position, and biased to move to the medium holding member 21 side in the case where the member is at a position which is closer to the medium holding member 21 with respect to the reference position.

Next, action of the medium receiving device 20 according to the embodiment will be described with reference to FIGS. 7A, 7B and 7C. The medium receiving device 20 causes the medium edge restricting member 32 to come out from the storage frame body 31 in the medium path change section 30 and to make contact with the medium receiving surface 21*s* in accordance with the length in the discharge direction of the cut sheet CS discharged from the main apparatus body 12 side, thereby restricting the movement of the leading edge SF in the discharge direction of the cut sheet CS. Note that the main apparatus body 12, and the base unit 19, the base member 29 and the arm 28 on one side are omitted in the side views illustrated in FIGS. 7A and 7B.

Figure 7A:
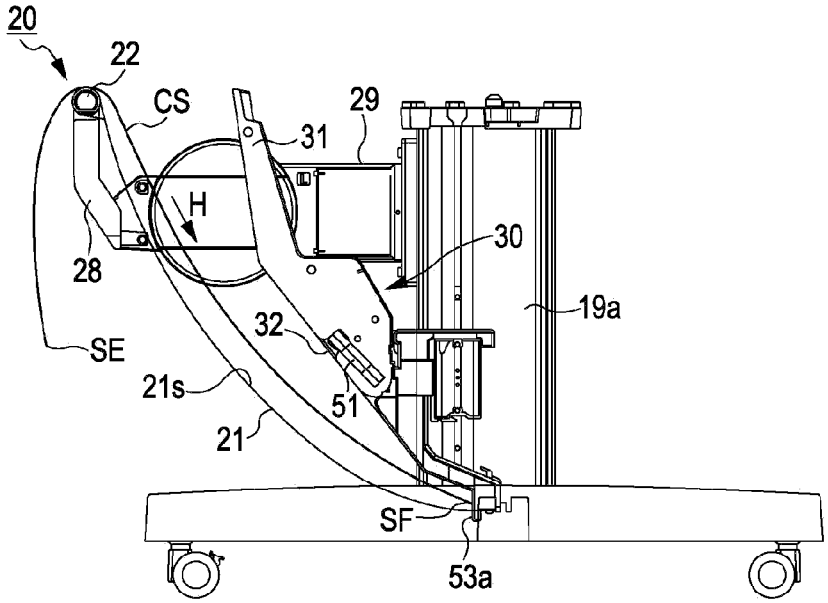
FIG. 7A is a side view of the medium receiving device illustrating a state in which the medium edge restricting member is at a non-restricting position.

As shown in FIG. 7A, in the case where the length in the discharge direction of the cut sheet CS to be discharged is longer than a predetermined length (e.g., length equivalent to the A1 paper size), the medium edge restricting member 32 is kept being stored in the storage frame body 31 in the medium path change section 30. Therefore, the leading edge SF in the discharge direction of the cut sheet CS moves along the medium receiving surface 21*s* (the arrow H) until it makes contact with the catching portion 53*a*. Then, while the movement of the leading edge SF in the discharge direction is being restricted due to the above contact, a part on the following edge SE side of the cut sheet CS hangs down by an adequate length, whereby the cut sheet CS can be received in an appropriate holding mode. Note that the above holding mode is the same as the holding mode of the cut sheet CS indicated by a double-dot dash line in FIG. 1.

Figure 7B:
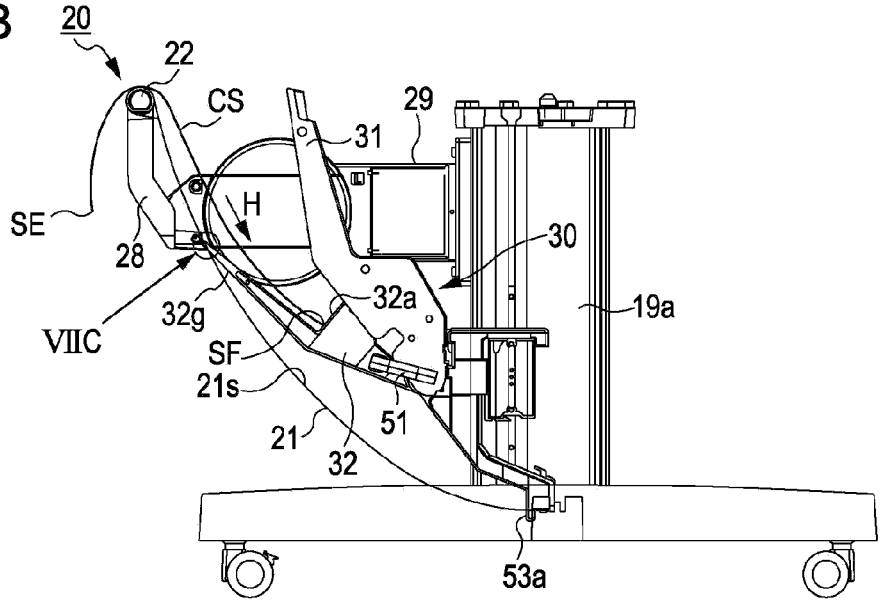
FIG. 7B is a side view of the medium receiving device illustrating a state in which the medium edge restricting member is at a restricting position.
Figure 7C:
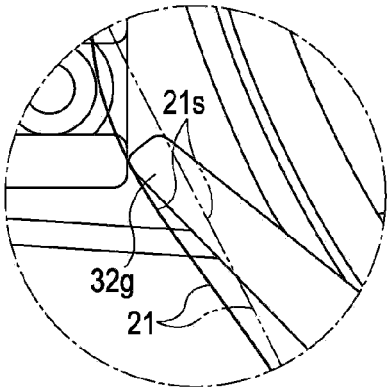
FIG. 7C is an enlarged view of a portion indicated by an arrow VIIC in FIG. 7B.

Next, as shown in FIG. 7B, in the case where the length in the discharge direction of the cut sheet CS to be discharged is shorter than the predetermined length (e.g., length equivalent to the A1 paper size), the medium edge restricting member 32 is made to come out from the storage frame body 31 in the medium path change section 30. Then, the tip of the guidance portion 32*g* of the medium edge restricting member 32 is made to be in contact with the medium receiving surface 21*s* of the medium holding member 21. With this, the leading edge SF in the discharge direction of the cut sheet CS is guided from the medium receiving surface 21*s* to the guidance portion 32*g* (the arrow H) and moves along the guidance portion 32*g*, then makes contact with the restricting portion 32*a*. Subsequently, a part on the following edge SE side of the short cut sheet CS, whose movement of the leading edge SF in the discharge direction is restricted by the above contact, hangs down by an adequate length, whereby the cut sheet CS can be received in an appropriate holding mode in the medium receiving device 20.

Accordingly, in this embodiment, when the guidance portion 32*g* of the medium edge restricting member 32 is in a state of touching the medium receiving surface 21*s*, the touch position of the medium edge restricting member 32 is a restricting position. Meanwhile, when the guidance portion 32*g* of the medium edge restricting member 32 is in a state of being separate from the medium receiving surface 21*s*, and in particular, being stored in the storage frame body 31, the storage position of the medium edge restricting member 32 is a non-restricting position.

In this embodiment, when the medium edge restricting member 32 is swung so as to come out from the storage frame body 31, the medium edge restricting member 32 is biased at the restricting position by the torsion coil spring 55, as described above. Accordingly, as shown in FIG. 7C, the tip of the guidance portion 32*g* makes contact with the medium holding member 21, whose state of being untouched is indicated by a double-dot dash line in the drawing, pushing it in a normal direction of the medium receiving surface 21*s* as indicated by a full line in the drawing. In this contact described above, the respective medium edge restricting members 32 make contact with the medium receiving surface 21*s* without a gap therebetween in the following manner: that is, each of the guidance portions 32*g* of the medium edge restricting members 32 freely moves in the circumferential direction due to the gap G, which is provided between the connecting bar 52 and the through-hole 32H in the movement direction, toward the medium receiving surface 21*s* side. Hereinafter, the state of this contact will be explained with reference to FIGS. 8A and 8B.

Figure 8A:
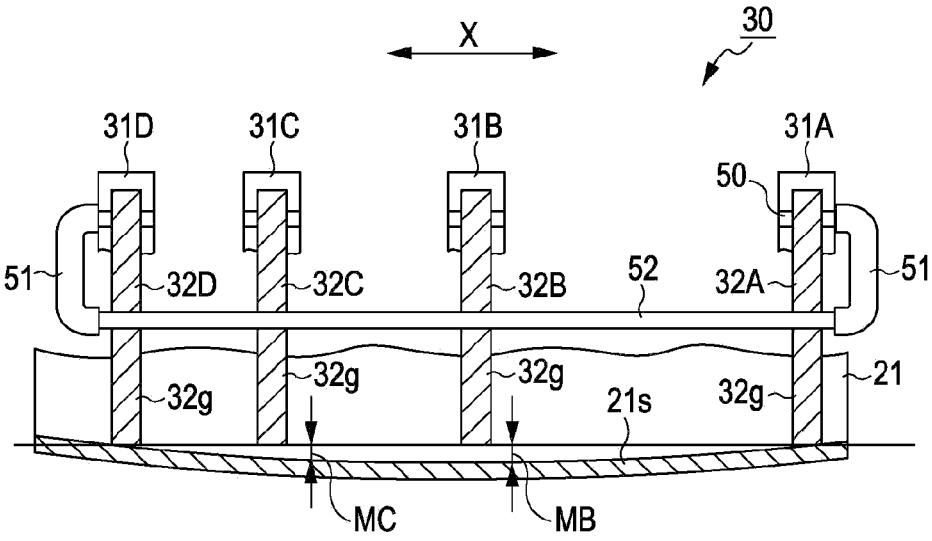
FIGS. 8A and 8B are schematic diagrams each illustrating a state in which the medium edge restricting member has moved to the restricting position; specifically.

As shown in FIG. 8A, as a comparative example with respect to this embodiment, in the case where any gap is not provided between the connecting bar 52 and the through-holes 32H in the movement direction, the four medium edge restricting members 32A, 32B, 32C and 32D swing simultaneously in a cooperative manner in the medium path change section 30 being interlocked with the movement of the connecting bar 52 in the circumferential direction. Accordingly, for example, the tip positions of the guidance portions 32*g* of the medium edge restricting members 32A, 32B, 32C and 32D are all overlapped each other when viewed from the axis line direction of the rotational shaft 50; that is, the respective guidance portions 32*g* move in the circumferential direction in a manner such that the relationship of the tip positions thereof in the movement direction does not relatively change between the restricting position and the non-restricting position. Meanwhile, the medium holding member 21 is likely to bend along a width direction (a two-headed arrow X) of the medium receiving surface 21*s* because the central portion of the medium receiving surface 21*s* in the width direction is likely to expand in comparison with the end portions thereof having seams. As a result, there exists difference in movement amounts of the guidance portions 32*g* of the respective medium edge restricting members 32 necessary to reach and make contact with the medium receiving surface 21*s* which bends along the width direction. Accordingly, for example, as shown in FIG. 8A, gaps MB and MC are respectively formed in the movement direction between the medium receiving surface 21*s* and the tips of the guidance portions 32*g* of the medium edge restricting members 32B and 32C attempting to touch the bending central portion in the width direction.

Figure 8B:
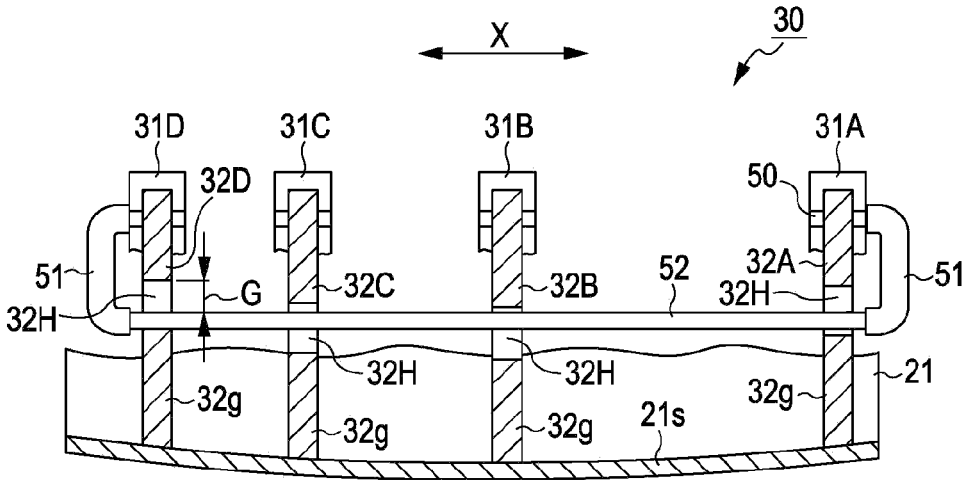

In contrast, as shown in FIG. 8B, in the case where the gaps G are provided between the connecting bar 52 and the through-holes 32H in the movement direction (a direction of the circumferential-direction movement), the four medium edge restricting members 32, at the restricting position, freely swing individually to the extent within the rotational amounts equivalent to the respective gaps G without being interlocked with the movement of the connecting bar 52 in the circumferential direction. Therefore, the tip positions of the guidance portions 32*g* of the medium edge restricting members 32A, 32B, 32C and 32D freely move (swing) individually in a normal direction with respect to the medium receiving surface 21*s* bending along the width direction so that the tips of the respective guidance portions 32*g* make contact with the medium receiving surface 21*s* without a gap therebetween. In other words, the gaps G provided in the movement direction between the connecting bar 52 and the through-holes 32H of the respective medium edge restricting members 32A, 32B, 32C and 32D, cancel out the difference in the movement amounts of the respective guidance portions 32*g* necessary to reach and make contact with the medium receiving surface 21*s*.

Note that in FIG. 8B, the medium edge restricting member 32D makes contact with the medium receiving surface 21*s* by the least amount of movement (amount of swing), in which the connecting bar 52 is in contact with the through-hole 32H of the medium edge restricting member 32D at a side in the movement direction to the restricting position. At this time, the other medium edge restricting members 32A, 32B and 32C in contact with the medium receiving surface 21*s*, are in a state such that the connecting bar 52 can swing freely in the respective through-holes 32H without making contact therewith to the extent within the swing amounts equivalent to the gaps G. Accordingly, the medium edge restricting members 32A, 32B and 32C freely swing individually so as to swing by larger amounts of movement than the medium edge restricting member 32D; as a result, the respective guidance portions 32*g* make contact with the medium receiving surface 21*s*.

In the case where the medium edge restricting members 32 are needed to be moved from the restricting position to the non-restricting position, a user of the recording apparatus 11 grips the handle 51 and moves the connecting bar 52 about the rotational shafts 50 in the circumferential direction so that the guidance portions 32*g* are separated from the medium receiving surface 21*s*. At this time, since each of the guidance portions 32*g* is biased to the medium receiving surface 21*s* side by the torsion coil spring 55 during the movement to the reference position, the connecting bar 52 is caused to make contact with a portion on the side indicated by the double-dot dash line in FIG. 4, that is, on the storage frame body 31 side, so as to swing the respective medium edge restricting members 32 together.

According to the above-described embodiment, the following effects can be obtained.

1. In the plurality of medium edge restricting members 32 that are moved together by the connecting bar 52, in the case where movement amounts (swing amounts) of the respective guidance portions 32*g* necessary to reach and make contact with the medium receiving surface 21*s* are different from each other, the gaps G provided between the connecting bar 52 and the through-holes 32H of the medium edge restricting members 32 in the movement direction cancel out the difference in the movement amounts. That is, by providing the gaps G in accordance with the difference in the movement amounts, it is possible to cause the guidance portions 32*g* of the plurality of medium edge restricting members 32 to make contact with the medium receiving surface 21*s*. As a result, because the leading edge SF in the discharge direction of the cut sheet CS can be surely guided from the medium receiving surface 21*s* to the restricting portions 32*a* of the medium edge restricting members 32, the medium receiving device 20 can receive the cut sheet CS to be discharged in an appropriate holding mode.

2. Since each of the through-holes 32H includes the gap G between the through-hole 32H and the connecting bar 55 in the swing direction of each of the medium edge restricting members 32, when the plurality of medium edge restricting members 32 are rotated through engaging with the connecting bar 52 and moved between the restricting position and the non-restricting position, the gaps G provided in the movement direction cancel out the difference in the movement amounts. This makes it possible to cause the respective guidance portions 32*g* of the plurality of medium edge restricting members 32 to be in contact with the medium receiving surface 21*s*.

3. Since each of the through-holes 32H is arranged at a different position from the center of the rotational shaft 50 as a reference when the medium edge restricting member 32 swings, the connecting bar 52 engages with the through-holes 32H that are arranged being distanced from the rotational shafts 50 of the plurality of medium edge restricting members 32, and moves (swings) the medium edge restricting members 32 with the moment force generated about the rotational shafts 50. As a result, the connecting bar 52 can move the guidance portions 32*g* of the plurality of medium edge restricting members 32 with ease.

4. Since the connecting bar 52 is a shaft member that is inserted through the through-hole 32H and whose cross-section with an axis line in the width direction is formed in a polygonal shape having the same number of corners as the through-hole 32H, the connecting bar 52 that moves and the through-hole 32H can be easily engaged with each other by causing the surfaces thereof to make contact with each other. Therefore, the connecting bar 52 can stably move the medium edge restricting member 32.

5. In the case where the medium edge restricting member 32 is at the restricting position, the storage frame body 31 guides the cut sheet CS to be discharged to an area between the storage frame body 31 and the guidance portion 32*g*; therefore, in a state of the medium edge restricting member 32 being at the non-restricting position in which the guidance portion 32*g* is being stored, the storage frame body 31 guides the cut sheet CS to be discharged to an area between the storage frame body 31 and the medium receiving surface 21*s*. In addition, in a state of the medium edge restricting member 32 being at the restricting position in which the guidance portion 32*g* has moved out from the storage frame body 31 to be in contact with the medium receiving surface 21*s*, the storage frame body 31 can guide the cut sheet CS to be discharge to an area between the storage frame body 31 and the guidance portion 32*g*. Therefore, it is possible to prevent the medium receiving device from becoming large because a movement range in which the medium edge restricting member 32 moves falls into to a range between the storage frame body 31 and the medium receiving surface 21*s*.

6. The single torsion coil spring 55 is provided that biases the medium edge restricting member 32 to make it move toward the restricting position in the case where the medium edge restricting member 32 is at a position on the restricting position side relative to a reference position, and also biases the medium edge restricting member 32 to make it move toward the non-restricting position in the case where the medium edge restricting member 32 is at a position on the non-restricting position side relative to the above reference position. Accordingly, since the single bias member biases the medium edge restricting member 32 toward the two stable positions for the medium edge restricting member 32, it is possible to realize the medium receiving device 20 in which complexity of the device structure due to an increased number of bias members is suppressed.

7. It is possible to obtain the recording apparatus 11 that can surely guide the leading edge SF in the discharge direction of the cut sheet CS from the medium receiving surface 21*s* to the restricting portion 32*a* of the medium edge restricting member 32.

The aforementioned embodiment can be varied to other embodiments as follows.

Figure 9:
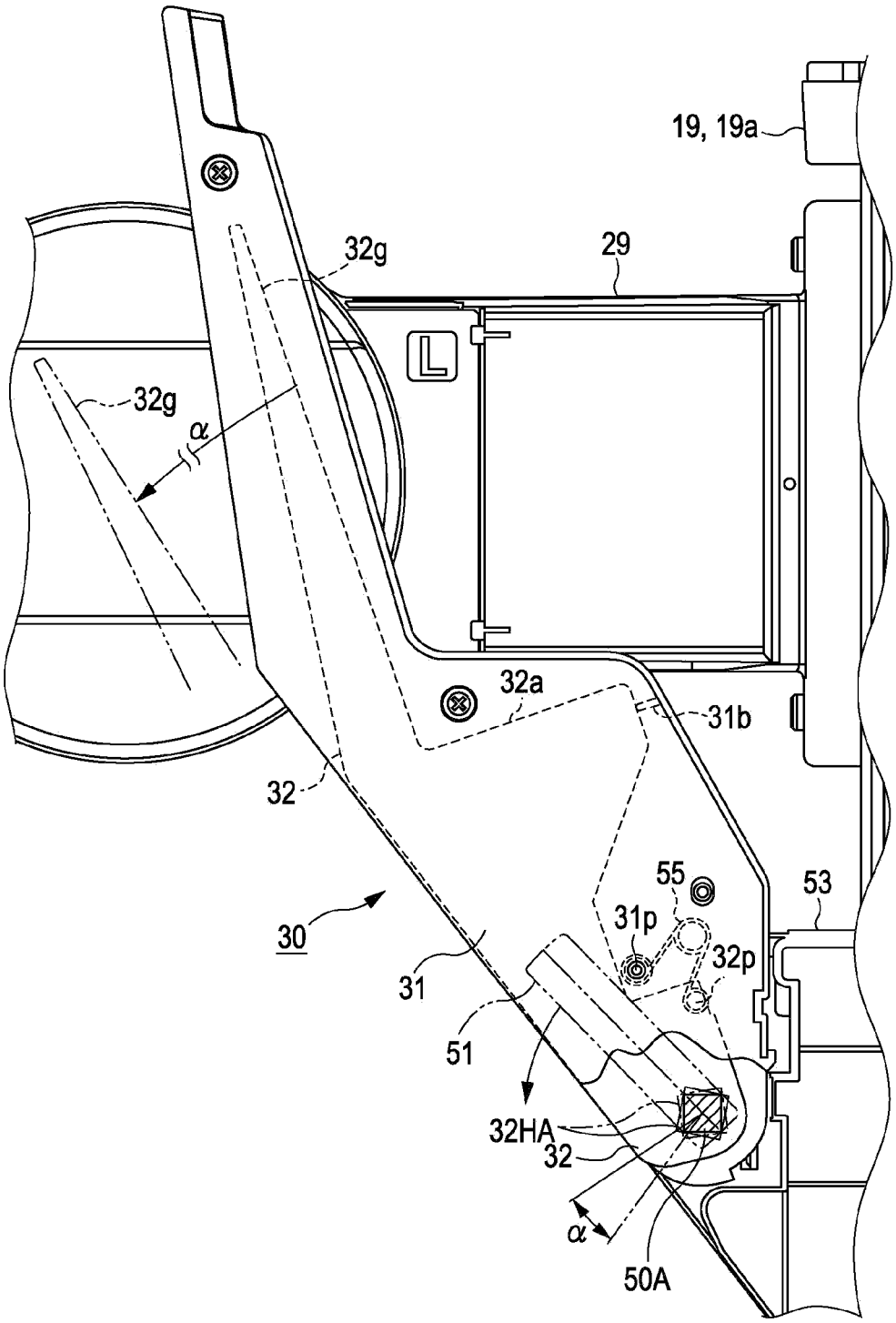
FIG. 9 is a structural drawing illustrating a variation on the movement member.

In the aforementioned embodiment, although the through-hole 32H with which the connecting bar 52 engages is arranged at a different position from the center of the rotational shaft 50 about which the medium edge restricting member 32 rotates, the invention is not limited thereto. For example, the through-hole 32H with which the connecting bar 52 engages may be arranged at the same position as the center of the rotational shaft 50 as a reference when the medium edge restricting member 32 swings; this variation will be described below with reference to FIG. 9. In FIG. 9, same constituent members as those in the aforementioned embodiment are given the same reference numerals, and descriptions thereof will be omitted.

As shown in FIG. 9, in this variation, a connecting bar 50A whose cross-section is quadrilateral is disposed as the rotational shaft 50 of the aforementioned embodiment, and so structured as to have the same function as the connecting bar 52 of the aforementioned embodiment. In other words, each of the medium edge restricting members 32 includes a through-hole 32HA whose shape is quadrilateral like the connecting bar 50A and that is slightly larger in size than the connecting bar 50A; the connecting bar 50A is inserted through the through-holes 32HA.

As a result, in each of the medium edge restricting members 32, a gap, or a swing backlash of an angle $\alpha$ is formed as indicated by a full line and a double-dot dash line in the drawing; with this gap, the medium edge restricting member 32 swings freely, being centered at the connecting bar 50A as a rotation center, between two positions at which the through-hole 32HA makes contact with the corners of the connecting bar 50A. Accordingly, the respective medium edge restricting members 32, at the restricting position, freely move (swing) individually to the extent within the swing amounts equivalent to the respective swing backlashes of the angle $\alpha$ without being interlocked with the movement in the circumferential direction of the connecting bar 50A, as in the aforementioned embodiment. With this, the tip positions of the guidance portions 32*g* of the medium edge restricting members 32A, 32B, 32C and 32D freely swing individually in a normal direction with respect to the medium receiving surface 21*s* bending along the width direction, so that the tips of the respective guidance portions 32*g* make contact with the medium receiving surface 21*s* without a gap therebetween, as in the aforementioned embodiment.

According to this variation, the following effect can be obtained, in addition to the effects 1 through 7 of the aforementioned embodiment.

8. In the case where the connecting bar 50A is a shaft member that is positioned on the shaft center of the rotational shaft 50 of the medium edge restricting member 32, that is, in the case where the rotational shaft functions as the movement member, the connecting bar 50A whose cross-section is quadrilateral can surely swing the medium edge restricting member 32 by engaging (making contact) with the through-hole 32HA on the corners without slipping.

In the medium receiving device 20 according to the aforementioned embodiment and the variation, the shapes of cross-section of the connecting bars 52 and 50A are not limited to a quadrilateral; they may be, for example, a triangle, pentagon or hexagon. Any shape can be used as long as it is a polygon having multiple corners. In the case where a cross-section is quadrilateral, it is acceptable that the shape thereof is not square, but rectangular.

In the medium receiving device 20 according to the aforementioned embodiment, the connecting bar 52 may not be quadrilateral (polygonal), but circular. In this case, the through-hole 32H is not necessarily needed to be a through-hole having a quadrilateral (polygonal) shape, and may be a through-hole having a shape with which a gap is formed between the through-hole and the circular connecting bar 52 in the rotational direction (for example, an elongated-hole shape, an elliptical shape, or the like).

In the medium receiving device 20 according to the aforementioned embodiment, a spring other than the torsion coil spring 55 may be used as a bias member that biases the medium edge restricting member 32. For example, a coil spring may be used, or a cam and a plate spring may be used in combination. Any bias member can be used as long as it functions as a so-called "2-position stabilization spring" which biases the medium edge restricting member 32 so that both the restricting position and the non-restricting positions are the stable positions for the medium edge restricting member 32.

Alternatively, in the medium receiving device 20 according to the aforementioned embodiment, for example, in the case where the guidance portion 32*g* at the restricting position is arranged and structured so as to push the medium receiving surface 21*s* under the own-weight of the medium edge restricting member 32, the bias member to bias the medium edge restricting member 32 is not necessarily needed to be provided.

In the medium receiving device 20 according to the aforementioned embodiment, the storage frame body 31 in which the guidance portion 32*g* is stored when the medium edge restricting member 32 has moved to the non-restricting position, is not necessarily needed to be provided. For example, if the device is structured so that the discharged cut sheet CS is guided to the restricting portion 32*a* and kept in a state of being in contact therewith when the medium edge restricting member 32 has moved to the restricting position, the storage frame body 31 that guides the cut sheet CS to an area between the storage frame body 31 and the guidance portion 32*g* is unnecessary.

In the medium receiving device 20 according to the aforementioned embodiment, it is not necessarily needed for the plurality of medium edge restricting members 32 to move between the restricting and non-restricting positions by the rotation about the rotational shafts 50. For example, the medium edge restricting members 32 may be so structured as to move in a sliding manner between the restricting and non-restricting positions. In this case, needless to say, the connecting bar 52 is so structured as to move in a sliding manner, and the gap G is formed between the through-hole 32H and the connecting bar 52 in a sliding direction thereof.

In the medium receiving device 20 according to the aforementioned embodiment, of the plurality of medium edge restricting members 32, all of the medium edge restricting members 32 are not necessarily required to form the gaps G between the through-holes 32H and the connecting bar 52 in the movement direction. For example, in the description of FIG. 8A, as the gaps MB and MC are generated between the bending medium receiving surface 21*s* and the medium edge restricting members 32B and 32C, it is sufficient that the gaps G are formed in the medium edge restricting members 32B and 32C. It is sufficient that the gap G is formed in at least one of the medium edge restricting members 32 in accordance with a shape along the width direction of the medium receiving surface 21*s* in the manner describe above.

In the aforementioned embodiment, the medium receiving device 20 is not necessarily needed to be included in the recording apparatus 14 having the recording section 14. For example, the invention can be applied to any medium receiving device that receives a recorded sheet at the gravitational direction side.

In the aforementioned embodiment, the recording apparatus may be a fluid ejecting apparatus that performs recording by discharging or ejecting fluid other than ink (including a liquid, a liquid-form material in which the particles of a functional material are dispersed or mixed in a liquid, a fluid-form material such as gel, and a solid that can be flowed as a fluid and can be ejected). For example, a liquid-form material ejecting apparatus that performs recording by ejecting a liquid-form material containing materials such as electrode materials and coloring materials (pixel materials) in a dispersed or dissolved state for use in the manufacture of liquid-crystal displays, EL (electroluminescence) displays and surface light emission displays, can be cited. In addition, a fluid-form material ejecting apparatus that ejects a fluid-form material such as gel (e.g., physical gel) and a particulate-matter ejecting apparatus (e.g., a toner jet recording apparatus) that ejects a solid whose example is powder (particulate matter) such as toner, can be also cited. The invention can be applied in any one type of the fluid ejecting apparatuses described above. Note that, in this specification, "fluid" is a concept including liquid while excluding a fluid that contains only a gas; and the fluid includes, for example, liquids (inorganic solvent, organic solvent, solution, liquid resin, liquid metal (metallic melt) and the like), liquid-form materials, fluid-form materials, particulate matter (including particles and powder) and the like.

The entire disclosure of Japanese Patent Application No. 2012-100919, filed Apr. 26, 2012 is expressly incorporated by reference herein.

What is claimed is:

1. A medium receiving device comprising:

a medium holding member having a medium receiving surface that receives a part on a leading edge side in a discharge direction of a medium to be discharged;

a plurality of medium edge restricting members that are arranged along a width direction of the medium orthogonal to the discharge direction, each of the medium edge restricting members including a restricting portion that restricts movement of the leading edge in the discharge direction of the medium to the discharge direction and a guidance portion that makes contact with the medium receiving surface so as to guide the leading edge of the medium from the medium receiving surface to the restricting portion; and a movement member that moves the plurality of medium edge restricting members together between a restricting position where the guidance portion makes contact with the medium receiving surface so as to guide the leading edge of the medium to the restricting portion and a non-restricting position where the guidance portion is separate from the medium receiving surface and does not guide the leading edge of the medium to the restricting portion, by being engaged with engagement portions provided in the medium edge restricting members, wherein at least one of the engagement portions respectively provided in the plurality of medium edge restricting members includes a gap between the at least one engagement portion and the movement member in a movement direction of the medium edge restricting member.

2. The medium receiving device according to claim 1, wherein each of the plurality of medium edge restricting members is rotatably provided about a rotational shaft having an axis line in a width direction of the medium, and each of the engagement portions includes the aforementioned gap between the engagement portion and the movement member in a rotational direction of each of the medium edge restricting members.

3. The medium receiving device according to claim 2, wherein the engagement portion with which the movement member engages is arranged at a different position from a center of the rotational shaft about which the medium edge restricting member rotates.

4. A recording apparatus comprising:

a recording section that performs recording by adhering a liquid to a medium;

a discharge section that discharges the medium from the recording section; and the medium receiving device according to claim 3.

5. A recording apparatus comprising:

a recording section that performs recording by adhering a liquid to a medium;

a discharge section that discharges the medium from the recording section; and the medium receiving device according to claim 2.

6. The medium receiving device according to claim 1, wherein the at least one engagement portion is a polygonal through-hole and the movement member is a shaft member that is inserted through the above through-hole and whose cross-section with an axis line in the width direction of the medium is formed in a polygonal shape having the same number of corners as the at least one engagement portion.

7. A recording apparatus comprising:

a recording section that performs recording by adhering a liquid to a medium;

a discharge section that discharges the medium from the recording section; and the medium receiving device according to claim 3.

8. The medium receiving device according to claim 1, wherein, in the case where the medium edge restricting member is at the non-restricting position, a storage unit which stores at least the guidance portion is provided, the storage unit is arranged on a side opposed to the medium receiving surface of the medium holding member and guides the medium to be discharged to an area between the storage unit and the medium receiving surface, and the storage unit guides the medium to be discharged to an area between the storage unit and the guidance portion in the case where the medium edge restricting member is at the restricting position.

9. A recording apparatus comprising:

a recording section that performs recording by adhering a liquid to a medium;

a discharge section that discharges the medium from the recording section; and the medium receiving device according to claim 8.

10. The medium receiving device according to claim 1, wherein the medium receiving device includes a single bias member that biases the medium edge restricting member so that the medium restricting member is caused to move toward the restricting position in the case where the medium edge restricting member that moves is at a position on the restricting position side relative to a reference position between the restricting position and the non-restricting position, and also biases the medium edge restricting member so that the medium edge restricting member is caused to move toward the non-restricting position in the case where the medium edge restricting member is at a position on the non-restricting position side relative to the above reference position.

11. A recording apparatus comprising:

a recording section that performs recording by adhering a liquid to a medium;

a discharge section that discharges the medium from the recording section; and the medium receiving device according to claim 10.

12. A recording apparatus comprising:

a recording section that performs recording by adhering a liquid to a medium;

a discharge section that discharges the medium from the recording section; and the medium receiving device according to claim 1.

* * * * *